United States Patent [19]

Neu et al.

[11] 4,065,931

[45] Jan. 3, 1978

[54] GUIDING ARRANGEMENT FOR UNDERGROUND EXCAVATING SYSTEMS

[75] Inventors: Gustav Neu, Bochum; Hans-Ferdinand Bemmerl, Herne, both of Germany

[73] Assignee: Bochumer Eisenhutte Heintzmann GmbH & Co., Bochum, Germany

[21] Appl. No.: 794,933

[22] Filed: May 9, 1977

[30] Foreign Application Priority Data

May 21, 1976 Germany ..... 2622886

[51] Int. Cl.[2] ..... E21D 15/44

[52] U.S. Cl. ..... 61/45 D

[58] Field of Search ..... 61/45 D; 299/31–33; 248/357; 91/170 MP

[56] References Cited

U.S. PATENT DOCUMENTS

| | | | |
|---|---|---|---|
| 3,434,292 | 3/1969 | Heyer | 61/45 D |
| 3,576,110 | 4/1971 | Warns | 61/45 D |
| 3,603,098 | 9/1971 | Groetschel | 61/45 D |
| 3,915,500 | 10/1975 | Schlusener et al. | 61/45 D |

FOREIGN PATENT DOCUMENTS

| | | | |
|---|---|---|---|
| 1,368,750 | 6/1964 | France | 61/45 D |
| 2,500,286 | 7/1976 | Germany | 61/45 D |

*Primary Examiner*—Dennis L. Taylor
*Attorney, Agent, or Firm*—Michael J. Striker

[57] ABSTRACT

An underground excavating system includes a conveyor device which is operative for conveying material away from a mine face, and an excavation roof support device which is operative for supporting the roof of the excavation. A hydraulic cylinder-piston unit is operatively connected to both of the devices and is operative for advancing one of the devices towards the mine face while the other of the devices remains stationary, and vice versa. A guiding arrangement is connected intermediate the control unit and the conveyor device and is operative for guiding the advancing device during its advance towards the mine face. The guiding arrangement includes a pair of elongated support members which are spaced apart of each other and which have one end region located closer to the mine face and another end region located further from the mine face. The guide arrangement further includes a pair of guide sleeve members one at each of the aforementioned end regions. Each sleeve member has wall portions which bound a passage through which the end portions of the support members pass at a spacing relative to each other. The arrangement further includes a pair of insert members respectively connectable to the conveyor device and the control unit. Each insert member is located in a respective passage of the sleeve members and is received between the end portions of the support members for maintaining these end portions at the aforementioned spacing. The insert members and the support members are detachably connected to the sleeve members so as to permit rapid interchange of any of the members which are defective with a replacement member.

22 Claims, 4 Drawing Figures

GUIDING ARRANGEMENT FOR UNDERGROUND EXCAVATING SYSTEMS

BACKGROUND OF THE INVENTION

The present invention generally relates to a conveyor device operative for conveying material away from a mine face, an excavation roof support device operative for supporting the roof of the excavation, and a hydraulic control unit operatively connected to both of these devices and operative for advancing one of the devices towards the mine face while the other of the devices remains stationary, and vice versa. More particularly, the present invention relates to means for guiding the advancing device during its advance towards the mine face.

It has been proposed in the prior art to connect a guiding arrangement intermediate a conveyor device and an excavation roof support device. With the aid of a hydraulic piston-cylinder control unit, the guiding arrangement serves to push one of these devices towards the mine face, and subsequently to pull the other of the devices stepwise towards the mine face. The guiding arrangement is pivotally connected with play to these devices so that slight freedom of relative movement exists during either the pushing or pulling stepwise movements.

The known guiding arrangements generally are comprised of one-piece, welded box-shaped sections which are not detachable from each other. Furthermore, the known guiding arrangements are of rigid massive construction. In other words, they cannot readily flex or yield to any appreciable extent. During normal operation, the guiding arrangements are subjected to relatively heavy loads which tend to frequently destroy the guiding arrangements or bend them to such an extent that they are no longer fit for use. The guiding arrangements which are very costly items must therefore be entirely replaced. Under normal operating conditions, this is very difficult and time-consuming, particularly in cases where mining personnel work in excavations having a height on the order of 0.5 meters.

SUMMARY OF THE INVENTION

Accordingly, it is a general object of the present invention to overcome the disadvantages of the prior art.

Another object of the present invention is to provide a multi-part guiding arrangement which need not be entirely replaced when any one or more of its parts is defective.

Still another object of the present invention is to provide a multi-part guiding arrangements whose parts are detachably connected to each other.

Still a further object of the present invention is to provide a reliable, improved and cost-effective guiding arrangement for use in underground excavating systems.

In keeping with these objects and others which will become apparent hereinafter, one feature of the invention resides in a combination in an underground excavating system which, briefly stated, comprises a conveyor device or scraper conveyor operative for conveying material away from a mine face, and an excavation roof support device operative for supporting the roof of the excavation. Advancing means, preferably a hydraulic cylinder-piston control unit, is operatively connected to both of the devices for advancing one of them towards the mine face while the other remains stationary, and vice versa. The guiding arrangement operative for guiding the advancing device during its advance towards the mine face includes a pair of spaced-apart elongated support members having one end region located closer to the mine face, and another opposite end region located further from the mine face. The guiding arrangement also includes a pair of guide sleeve members one at each of the end regions, each sleeve member having wall portions bounding a passage through which end portions of the support members pass at a spacing relative to each other. The guiding arrangement further includes a pair of insert members one being connectable with the conveyor device and the other being connectable with the advancing means. Each insert member is located in a respective passage of the sleeve members and is received between the end portions of the support members for maintaining the end portions at said spacing. The insert members and the support members are detachably connected to the sleeve members.

In accordance with the invention, the detachable connection between the insert members, support members and sleeve members permits rapid interchange of any of these members which are defective with a replacement or non-defective member when required. All of the members are therefore readily assembled and disassembled. The support members are of rigid, but resilient material, e.g. heat-treated spring steel, so that the support members can be slightly bent when subjected to loading forces and are readily returnable to their original orientation. This feature greatly increases the working lifetime and durability of the guiding arrangement.

The sleeve members maintain the opposite end regions of the support members from moving apart from each other and serve to reduce relative movement between the guiding arrangement and a pair of floor-engaging skids of the roof support device. Each sleeve member has an outer bearing surface, preferably but not necessarily convexly-curved, which is adapted to bear against a side portion of a skid which faces the respective sleeve member.

The detachable connection for the various members is achieved by cylindrical bolts which are mounted in cooperating mounting holes. Locking pins are used to lock the bolt in position. In other words, the lack of threaded connections permits easy handling and no special tools need be used in the assembly or disassembly of the various members of the guiding arrangement.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figures 1, 2, 3, 4:
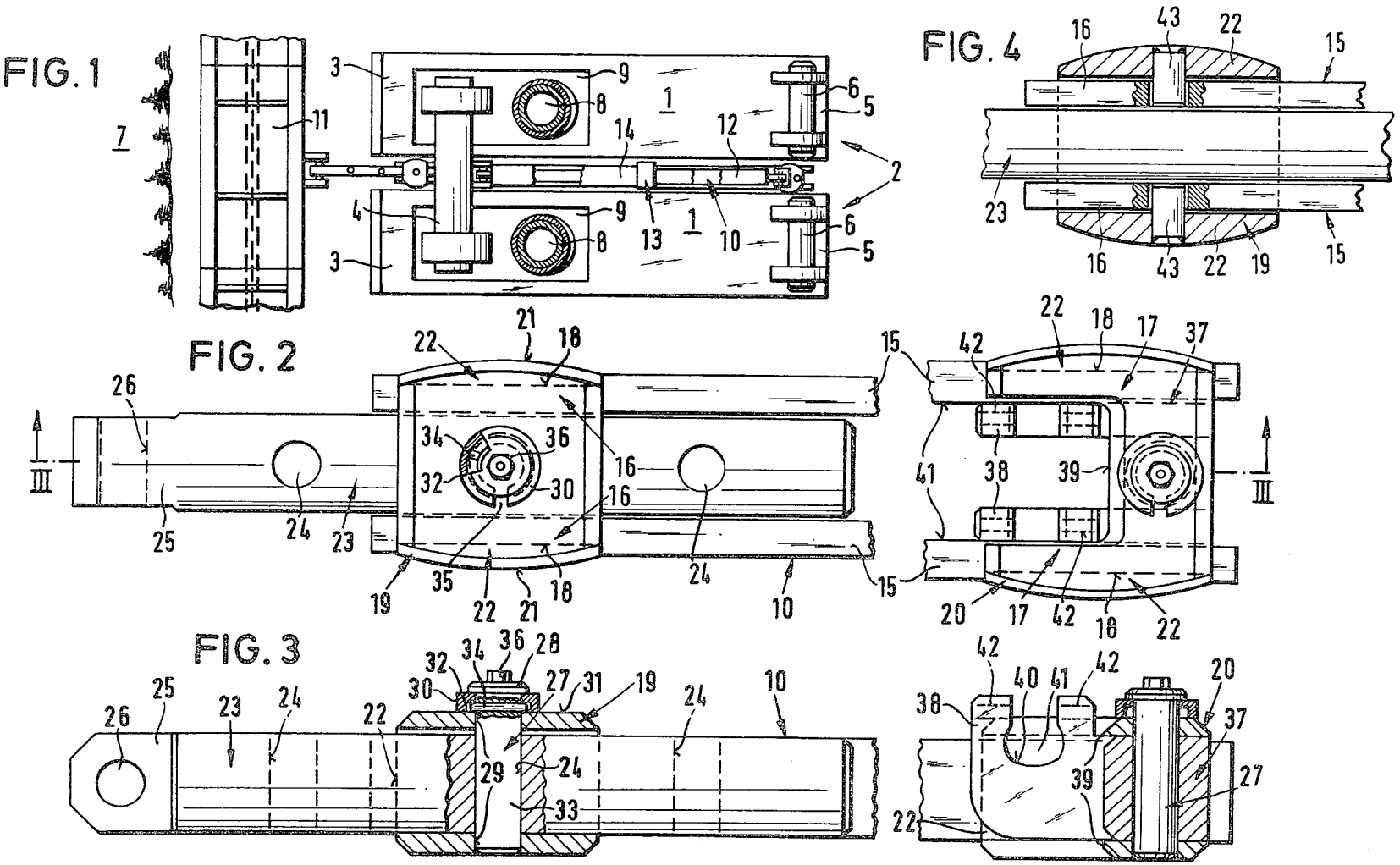
FIG. 1 is a top view of a partially illustrated conveyor and of a partially illustrated roof support of an underground excavating system in accordance with the present invention.
FIG. 2 is a broken-away, enlarged top view of the guiding means which interconnects the conveyor and the roof support of the system of FIG. 1.
FIG. 3 is a broken-away, enlarged sectional view taken on line III—III of FIG. 2.
FIG. 4 is a broken-away, enlarged, partially sectional view of a modification of the interconnection between the support members and the sleeve members of the system.

FIG. 1 illustrates a mine face 7, a conveyor device 11 operative for conveying material away from the mine face 7, and an excavation roof support device 2 operative for supporting the roof of an excavation. Advancing means 13 is operatively connected to both conveyor 11 and support 2 and is operative for either advancing the support 2 towards mine face 7 while conveyor 11 is stationary, or for advancing the conveyor 11 towards mine face 7 while support 2 is stationary. Guide means 10 is connected intermediate the conveyor 11 and the support 2 and is operative for guiding the respective advancing device during its advance towards the mine face 7. The present invention is primarily directed to the guiding means 10. The conveyor 11 (preferably a scraper conveyor), the support 2 and the advancing means 13 are conventional apparatuses in this art and hence are believed not to require any extended discussion of their individual features, except insofar as such apparatuses cooperate with the guiding means 10.

Roof support 2 comprises two floor-engaging skids 1 spaced apart from each other. Each skid 1 has a front portion 3 facing the mine face 7, and a rear portion 5 located further away from the mine face 7. Skids 1 are interconnected at front portions 3 by a bridge member 4 which has its opposite ends pivotally mounted in bearing blocks. Thus, each skid 1 can move in an up-and-down manner relative to the floor of the excavation and readily adapt to any surface irregularities thereof.

Hinge mountings 6 are provided on each rear portion 5 for pivotally connecting a rear shield to the support 2. The rear shield has not been illustrated for the purpose of clarifying the drawings, however, generally, the rear shield extends from the hinge mountings 6 in direction towards the mine face 7. The rear shield is in turn pivotally connected to a roof shield (also non-illustrated for the purpose of simplifying the drawing). The roof shield actually engages the roof of the excavation, and the rear shield is inclined relative to the roof shield and serves to reinforce the roof shield, as well as to divert any loose material falling from the roof in direction away from the mine face 7.

The roof shield extends towards the mine face 7 and is independently movable towards and away from the roof by pit props 8. Each pit prop 8 extends through a recess 9 and is mounted on a respective skid 1. Each pit prop 8 is composed of hydraulically-actuated telescoping sections which are extendable and/or retractable for moving the roof shield.

Advancing means 13 is comprised of a hydraulic control unit having a piston component 12 and a cylinder component 14. The piston subdivides the interior of the chamber into two chambers. The head of the piston and the closed end of the cylinder bound one chamber of predetermined volume, and the other chamber receives the shaft of the piston, thereby making the volume of the other chamber smaller than the predetermined volume of the first-mentioned chamber.

As shown in FIG. 1, cylinder 14 is pivotally connected to bridge 4, so that the relatively heavier support 2 can be moved by fluid in the relatively larger chamber. Piston component 12 is pivotally connected to the guide means 10 at an end region of the latter which is remote from the mine face. The closer end region of the guide means 10 is pivotally connected to conveyor 11. Thus, the relatively lighter conveyor 11 can be moved by fluid in the relatively smaller chamber. The guiding means 10 is located intermediate the skids 1 and is arranged to have some play or slight freedom of movement relative to the skids.

FIGS. 2 and 3 show the guiding means 10 in enlarged view. A pair of elongated support members 15 of quadrilateral cross-section are spaced apart of each other and have end regions 16 located closer to the mine face 7, and opposite end regions 17 located further from the mine face 7. Each end region has side walls and a bottom wall which together bound a generally transversely extending U-shaped cutout 18 at the exterior side of a respective support member 15.

Two guide sleeve members 19 and 20 are respectively located at each end region 16 or 17 of the support member 15. Each sleeve has wall portions 22 which bound a passage through which the respective end regions 16 or 17 pass at a spacing relative to each other. Each side wall of a respective end region engages a respective axial end portion of a sleeve member.

Each sleeve 19 or 20 is generally quadrilaterally shaped and has rounded outer side surfaces 21 which are adapted to bear against the respective sides of the skids 1. Each surface 21 is convexly curved. Sleeve 19 has a width dimension, as considered in direction transversely of the elongation of the support members 15, which is smaller than the width of the sleeve 20. Similarly, rear section 5 is less wide than front section 3. Thus, the support members 15 slightly diverge away from each other in direction away from the mine face 7. Sleeve 19 has a length dimension on the same order of magnitude as the length dimension of sleeve 20. The two sleeves are spaced lengthwise of the support members 15 by a distance equal to a multiple, preferably ten times, of the width of a single sleeve member.

Insert member or quadrilaterally-shaped rod member 23 is inserted intermediate support members 15 through the interior passage of sleeve 19. Rod 23 is dimensioned to be tightly received in this passage so that rod 23 serves to urge the bottom wall of a respective recess 18 into wedging engagement with a respective wall portion 22. Alternatively, the rod 23 need not be dimensioned to act as a wedging member. Mounting members or pins may be provided on each sleeve member, and the pins may extend from wall portions 22 respectively towards the interior of the respective passage. The pins may be fittingly receivable in registering recesses formed in a respective end region of the support members 15.

Rod 23 is further provided with a transversely extending hole 26 which is operative for connecting the free end 25 of rod 23 to the conveyor 11. A plurality of mounting holes 24, which extend normal to the extension of hole 26, are spaced lengthwise of rod 23. One of these mounting holes is selected to receive a shaft portion 33 of a bolt 27. The shaft portion 33 also extends through bores 29 which are formed on opposite sides of a respective sleeve member 19, 20 and which register with mounting hole 24.

A cup-shaped member or annular cap 30 is secured (e.g. by welding) to upper surface 31 of sleeve 19. Cap 30 has a shoulder which is spaced from upper surface 31 so as to form an annular groove 32 therewith. A planar head portion 28 of bolt 27 abuts against one side of this shoulder. A polygonally-shaped, preferably hexagonal, nut 36 is connected to the head portion 28 and serves to turn the bolt when the nut is engaged by a turning tool.

A locking pin 34 is mounted on shaft 33 and turns with the same. The pin 34 tightly engages the other side of the shoulder of the cap 30 when the pin 34 is received in groove 32. Entry and exit of pin 34 to the groove 32 is obtained by a radial slot 35 which communicates with the groove.

The locking pin 34 thereby serves to detachably connect the rod 23 and the support members 15 to the sleeve 19. A similar connecting arrangement exists — and hence will not be set forth in detail — for insert member 37 which is mounted in an interior passage of sleeve 20.

Insert member 37 has a generally rectangular configuration. Two bifurcated portions 38 are spaced transversely of each other and together bound a recess 39. Each bifurcated portion 38 has two upright legs which together bound a mounting recess 40 which is operative for receiving a hinge bolt portion of the piston component 12 intermediate the sides 41 of support members 15.

In order to prevent unauthorized disconnection of piston component 12 with insert member 37, a pair of channels 42 are respectively formed through both legs of a respective bifurcated portion 38. Pins are insertable into these channels 42 and serve to close the upper end of recesses 40 and thereby to retain the respective hinge bolt portions in a respective recess 40.

It will be understood that each of the elements described above, or two or more together, may also find a useful application in other types of constructions differing from the types described above.

While the invention has been illustrated and described as embodied in a guiding arrangement for underground excavating systems, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In an underground excavating system, a combination comprising a conveyor device for conveying material away from a mine face; an excavation roof support device for supporting the roof of the excavation; advancing means operatively connected to both of said devices for advancing one of said devices towards the mine face while the other of said devices remains stationary, and vice versa; and means for guiding said one device during its advance towards the mine face, including a pair of spaced apart elongated support members having one end region located closer to the mine face and another opposite end region located further from the mine face, a pair of guide sleeve members one at each of said end regions, each sleeve member having wall portions bounding a passage through which end portions of said support members pass at a spacing relative to each other, a pair of insert members one being connectable with said conveyor device and another being connectable with said advancing means, each insert member being located in a respective passage of said sleeve members and being received between said end portions of said support members for maintaining said end portions at said spacing, and means for detachably connecting said insert members and said support members to said sleeve members, whereby rapid interchange of any of said members which are defective with a replacement member is obtained.

2. The combination as defined in claim 1, wherein said roof support device includes a pair of skids spaced apart of each other; and wherein said guiding means is located intermediate said skids.

3. The combination as defined in claim 1, wherein said advancing means includes a hydraulic control unit having a piston component and a cylinder component, said cylinder component being pivotally connectable to said roof support device and said piston component being pivotally connectable to said other insert member.

4. The combination as defined in claim 1, wherein each sleeve member has a length dimension as considered in direction lengthwise of said support members, and wherein said sleeve members are spaced lengthwise of said support members at a distance which is a multiple of said length dimension of said sleeve member.

5. The combination as defined in claim 4, wherein said sleeve members are spaced lengthwise of said support members at a distance which is on the order of ten times said length dimension.

6. The combination as defined in claim 2, wherein each guide sleeve member has outer bearing portions each facing a respective skid, each bearing portion having a convexly-curved surface.

7. The combination as defined in claim 1, wherein each end portion of said support members has side walls and a bottom wall which together bound a generally U-shaped cutout, and wherein each insert member extends across said spacing and urges said respective bottom wall into engagement with said wall portions bounding said passage of a respective sleeve member.

8. The combination as defined in claim 1, wherein said sleeve member located at said other further end region has a width dimension, as viewed in direction transversely of the elongation of said support members, which is larger than the width dimension of said sleeve member located at said one closer end region; and wherein said support members diverge apart from each other in direction from said one closer end region towards said other further end region.

9. The combination as defined in claim 1, wherein each supporting member has a rectangular cross-section; and wherein each sleeve member has opposite axial ends; and wherein each end portion of said support members has a bottom wall and two side walls which together bound a generally U-shaped cutout, each side wall of a respective end portion engaging a respective axial end of a sleeve member.

10. The combination as defined in claim 1, wherein each support member is constituted by heat-treated steel.

11. The combination as defined in claim 1, wherein each support member is constituted by spring steel.

12. The combination as defined in claim 1, wherein each insert member has a mounting hole; and wherein said connecting means includes a bolt having a head portion and a shaft portion mounted in each of said mounting holes.

13. The combination as defined in claim 12, wherein said mounting holes and said shaft portions extend in direction transversely of the elongation of said support members.

14. The combination as defined in claim 12; and further comprising a cup-shaped member mounted on each insert member, each cup-shaped member including an abutment shoulder located at a distance from the respective sleeve member so as to define a gap therewith and having one side which engages said head portion; and also comprising a locking pin mounted on a respective shaft portion and extending into a respective gap, said locking pin engaging another side of said abutment shoulder for fixing said bolt in said mounting hole.

15. The combination as defined in claim 14, wherein said abutment shoulder of said cup-shaped member has a radial slot in communication with said gap and operative for permitting entry and exit of said locking pin relative to said gap.

16. The combination as defined in claim 12, and further comprising means for turning said bolt, including a polygonally-shaped nut mounted on said bolt.

17. The combination as defined in claim 12, wherein said one insert member is rod-shaped and has a plurality of mounting holes spaced lengthwise thereof; and wherein said shaft portion of a respective bolt is mounted in a selected one of said mounting holes.

18. The combination as defined in claim 1, wherein said one insert member is elongated and has a generally quadrilateral cross-section.

19. The combination as defined in claim 1, wherein said other insert member has two bifurcated portions spaced transversely of each other, each bifurcated portion having a pair of upright legs bounding a mounting recess therebetween.

20. The combination as defined in claim 19, wherein each bifurcated portion has a channel extending through both of said legs of a respective bifurcated portion.

21. The combination as defined in claim 1, wherein said connecting means includes mounting members mounted on each of said sleeve members, and recesses on each end region of said support members and operative for receiving said mounting members.

22. The combination as defined in claim 21, wherein said mounting members are pins extending from said wall portions of a respective sleeve member into said passage.

* * * * *